US007726232B2

(12) United States Patent
Furey et al.

(10) Patent No.: US 7,726,232 B2
(45) Date of Patent: Jun. 1, 2010

(54) DIAPHRAGM PUMP LINER FOR CRITICAL PROCESS APPLICATIONS

(75) Inventors: James F. Furey, Plainsboro, NJ (US); Dennis C. Annarelli, Newtown, PA (US); Jack McMickle, Nazareth, PA (US)

(73) Assignee: PendoTECH, Plainsboro, NJ (US)

( * ) Notice: Subject to any disclaimer, the term of this patent is extended or adjusted under 35 U.S.C. 154(b) by 337 days.

(21) Appl. No.: 12/037,805

(22) Filed: Feb. 26, 2008

(65) Prior Publication Data

US 2008/0202328 A1 Aug. 28, 2008

Related U.S. Application Data

(60) Provisional application No. 60/903,424, filed on Feb. 26, 2007.

(51) Int. Cl.
*F16J 10/04* (2006.01)
*F01B 19/00* (2006.01)

(52) U.S. Cl. ..... 92/171.1; 92/98 R

(58) Field of Classification Search ..... 92/98 R, 92/99, 101, 171.1; 417/413.1
See application file for complete search history.

(56) References Cited

U.S. PATENT DOCUMENTS 3,880,053 A * 4/1975 Trechsel et al. ..... 92/99
4,569,378 A * 2/1986 Bergandy ..... 92/98 D
5,154,589 A * 10/1992 Ruhl et al. ..... 417/446
5,193,977 A * 3/1993 Dame ..... 417/413.1
5,452,993 A * 9/1995 Lanigan ..... 417/413.1
5,540,568 A * 7/1996 Rosen et al. ..... 92/98 R

FOREIGN PATENT DOCUMENTS

WO WO9729284 8/1997

* cited by examiner

*Primary Examiner*—Michael Leslie
(74) *Attorney, Agent, or Firm*—Hoffman & Baron, LLP

(57) ABSTRACT

One embodiment of the invention relates to a liner for a first pump housing in a fluid pump assembly. The fluid pump assembly includes a first pump housing, a second pump housing and a flexible diaphragm disposed between the first and second pump housings. The first pump housing includes a fluid access port for providing fluid communication between an inside housing chamber of the first pump housing and an outside of the first pump housing. The second pump housing is securely mated to the first pump housing. The second pump housing includes a biasing mechanism for selectively displacing a portion of the diaphragm toward the first pump housing. The liner of the invention includes a flexible member removeably secured inside the first pump housing. The liner also includes a first portion of the member being shaped to substantially conform to the interior dimensions of the inside housing chamber and a second portion of the member shaped to substantially conform to the fluid access port. The member forms an inner liner chamber inside the inside housing chamber. The member also includes a mating portion for securing the member to the diaphragm to form a seal there between. The inner liner chamber being in fluid communication with the displaceable portion of the diaphragm. Whereby the displacement of the portion of the diaphragm expels fluid from the inner liner chamber through the fluid access port.

23 Claims, 4 Drawing Sheets

DIAPHRAGM PUMP LINER FOR CRITICAL PROCESS APPLICATIONS

The present application claims priority, in part, to provisional patent Application Ser. No. 60/903,424, filed Feb. 26, 2007. This earlier filed provisional application is incorporated herein by reference.

BACKGROUND OF THE INVENTION

Many fluid handling applications involving biopharmaceutical processes, including filtration, chromatography and mixing, require a pump to move liquid. In critical process applications the pumps are designed to be either easily cleaned and sanitized before and after each use or designed for single use, thus controlling or reducing microbial contamination. However, often these process applications require high quality components that demand precision or that can withstand added wear or high pressures, which makes the parts too valuable to throw away after a single or small number of uses. Also, having to clean and/or sanitize such high quality components can add delays or even increase costs.

A diaphragm style pump can be used to pump liquid in such critical process applications. In fact, they are used in processes with one pump "head" or with two or more pump "heads" depending on the application. The diaphragm pump cycles between drawing in liquid and expelling liquid from its inner pump chamber. The pump can draw liquid in by different means including gravity (from a pressure head), a vacuum to draw in the diaphragm, and/or by a piston type of mechanism. The pump can expel liquid by different means including a piston or air pressure. However, as with the critical process applications described above, diaphragm pumps are still required to be cleaned and/or sanitized between uses.

It is therefore desirable to provide an apparatus and method for use with a diaphragm pump for critical process applications that overcomes the shortcomings found in the prior art. In particular, an apparatus and method that allows such diaphragm assemblies to be easily cleaned, sterilized or uncontaminated between uses.

SUMMARY OF THE INVENTION

One embodiment of the invention relates to a liner for a first pump housing in a fluid pump assembly. The fluid pump assembly includes a first pump housing, a second pump housing and a flexible diaphragm disposed between the first and second pump housings. The first pump housing includes a fluid access port for providing fluid communication between an inside housing chamber of the first pump housing and an outside of the first pump housing. The second pump housing is securely mated to the first pump housing. The second pump housing includes a biasing mechanism for selectively displacing a portion of the diaphragm toward the first pump housing. The liner of the invention includes a flexible member removeably secured inside the first pump housing. The liner also includes a first portion of the member being shaped to substantially conform to the interior dimensions of the inside housing chamber and a second portion of the member shaped to substantially conform to the fluid access port. The member forms an inner liner chamber inside the inside housing chamber. The member also includes a mating portion for securing the member to the diaphragm to form a seal there between. The inner liner chamber being in fluid communication with the displaceable portion of the diaphragm, whereby the displacement of the portion of the diaphragm expels fluid from the inner liner chamber through the fluid access port.

Additionally, the liner member can be formed from a single unitary material. Also, the member can include a radially protruding housing flange secured between the first and second pump housings. Further, the member can include a nozzle flange radially extending from the second portion. The nozzle flange can be collapsible for insertion through the fluid access port. The second portion of the member can extend outwardly away from the first pump housing. The second portion can be flexible enough to fold over an outer portion of the fluid access port. The member and the flexible diaphragm can be permanently secured at the mating portion. Also, the member can be secured to the diaphragm by at least one of an adhesive and bonding agent. The flexible diaphragm can be integrally formed with the member and extending from the mating portion. The first pump housing can be removeably secured to the member. Also, the first pump housing can be formed by at least two removeably secured housing segments. Further, the first pump housing can include a sealing element disposed in a mating region between the housing segments.

Another embodiment of the invention relates to a fluid pump assembly including a first pump housing, a second pump housing, a flexible diaphragm and a flexible liner. The first pump housing includes a first inner chamber and a fluid access port for providing fluid communication between an outside of the first pump housing and the first inner chamber. The second pump housing is removeably secured to the first pump housing. The flexible diaphragm is disposed between the first and second pump housings. Also, a portion of the diaphragm is selectively displaceable toward the first pump housing. Further, the flexible liner is removeably secured substantially inside the first pump housing. The liner is shaped to substantially conform to the interior dimensions of the first inner chamber and the fluid access port. Also, the liner forms an inner liner chamber inside the first inner chamber, wherein displacement of the diaphragm toward the first pump housing expels fluid from the inner liner chamber.

Additionally, the liner can be formed from a single unitary material. Also, the liner can include a radially protruding housing flange secured between the first and second pump housings. Further, the liner can includes a nozzle flange radially protruding from the liner for engaging an outer portion of the fluid access port. The nozzle flange can be collapsible for insertion through the fluid access port. Also, the nozzle flange can be flexible enough to fold over an outer portion of the fluid access port. The liner can be secured to the diaphragm forming a seal there between. Also, the liner can be secured to the diaphragm by at least one of an adhesive and bonding agent. Further, the liner can be integrally formed with the diaphragm. The first pump housing can be formed by at least two removeably secured housing segments. Also, the first pump housing can include a sealing element disposed in a mating region between the housing segments.

These and other embodiments, features, and advantages of this invention will become apparent from the following detailed description of illustrative embodiments thereof, which is to be read in connection with the accompanying drawings.

DETAILED DESCRIPTION OF THE INVENTION

In accordance with an embodiment of the subject invention, a liner is provided inside an upper diaphragm pump housing, which can be easily removed and disposed of when needed so that the main pump parts can be re-used without the need to clean, sanitize and/or decontaminate them. Also, providing a liner can be more economical than disposing of single use pump parts. Further, a liner facilitates the use of more permanent and durable outer pump parts that are protected from wear or degradation by the liner.

Figure 1:
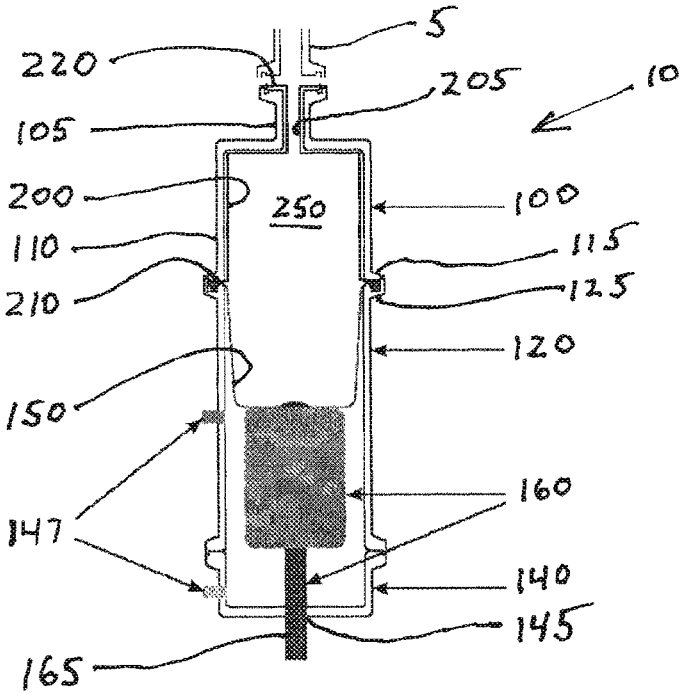
FIG. 1 is a cross-sectional view of a liner in a diaphragm pump assembly in accordance with an embodiment of the subject invention.

With reference to the drawings, FIG. 1 shows a fluid diaphragm pump assembly 10 for coupling to a process application 5. The pump assembly 10 includes an upper pump housing 100, a lower pump housing 120, a flexible diaphragm 150 and a removable flexible liner 200 (the liner 200 is drawn as a solid line covering the upper, inside and lower surfaces of the upper pump housing 100).

In a preferred embodiment, shown in FIG. 1, the liner 200 covers the upper, inside and lower surfaces (referred to as the working surfaces) of the upper pump housing 100. The upper housing 100 preferably includes a cylindrical main portion 110 and a nozzle 105 for in taking and expelling fluid. The upper housing 100 is secured to a lower pump housing 120 preferably by clamping together flanges 115, 125. Contemporary clamping techniques can be used, such as a sanitary clamp, tri-clamp or a locking collar (not shown). The lower pump housing 120 guides and supports a biasing mechanism 160. In the embodiment shown, biasing mechanism 160 includes a piston assembly for moving the diaphragm 150, with piston stem 165 passing through an aperture 145 in a lower portion 140 of the lower pump housing 120. However, the biasing mechanisms 160 can alternatively include a fluid pressure source, which applies a pressure force to bias the diaphragm 150 accordingly. While the lower portion 140 can be integrally formed with the lower pump housing 120, it can also be two separate elements joined together as shown. Also, the lower pump housing 120 and/or lower portion 140 can include one or more vacuum and/or air ports 147.

The flexible diaphragm 150 includes an upper flange that is secured between the upper and lower housing flanges 115, 125. The flexible diaphragm retains fluid in the diaphragm pump compartment. The flexible diaphragm 150 allows the pump to intake and expels fluid, yet acts as a barrier preventing such fluid from crossing through or past the diaphragm 150 between the upper and lower housings 100, 120. Preferably, the diaphragm 150 is a durable, flexible material such as silicone or a thermoplastic elastomer. It may even have a fabric component within the flexible material to provide additional strength. Different methods, such as a clamp, can be used to secure the upper and lower pump housings 100, 120 together, which in turn secure the diaphragm 150 in place. A more detailed disclosure of similar diaphragm pump, but without a liner 200, is provided in a co-pending patent application, Ser. No. 11/920,413, entitled "Sanitary Diaphragm Pump for Critical Bioprocess Applications," commonly assigned to PendoTECH, which is incorporated herein by reference.

The fluid diaphragm pump assembly 10 thereby forms a fluid chamber 250 between an upper surface of the diaphragm 150 and the inner surfaces of the liner 200. In this way, the liner 200 and the diaphragm 140 are the only elements of the diaphragm pump assembly 10 that come in contact with the fluid. In contrast, the chamber inside the lower pump housing 120 and below the diaphragm 150 does not ever come in contact with the critical process mixing fluids that enter chamber 250. Thus, when the diaphragm pump assembly 10 cycles between drawing-in and expelling fluid from chamber 250, at least a portion of the diaphragm 150 is adapted to extend back and forth between the inside of the upper and lower housings 100, 120. Preferably, substantially the entire diaphragm 150, less the secured upper flanges, can be forced to deflect toward and/or away from the nozzle 105.

Figure 2:
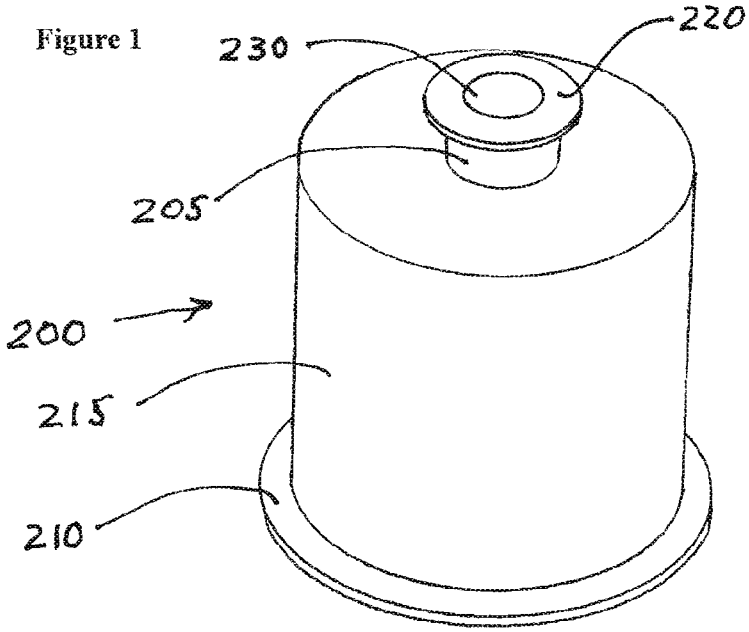
FIG. 2 is a perspective view of a diaphragm pump liner in accordance with an embodiment of the subject invention.

As shown in FIG. 2, the liner 200 preferably includes a main cylindrical portion 215, a lower coupling flange 210 and a nozzle insert portion 205. Preferably, the lower coupling flange 210 of the liner 200 is sealed between the upper pump housing 100 and the diaphragm 150. In turn, the diaphragm 150 is sealed between the lower pump housing 120 and the liner 200. The liner 200 continuously covers all inner surfaces from the connection to the process 5 to the diaphragm 150. Preferably, the liner 200 is shaped to substantially conform to the interior shape and dimensions of the upper pump housing 100. In this way, upon installation, the outer surfaces of the liner 200 directly engage substantially all inner surfaces of the upper pump housing 100. A tight match between the upper housing 100 and the liner 200 can minimize air or fluids getting between the liner and the internal surface of the upper housing 100. The tight match can help resist relative movement between the liner 200 and the upper housing 100, as the pump 10 cycles between drawing and expelling fluid. Also, the fact that the lower coupling flange 210 is secured to and sealed with the upper housing 100 also prevents air or fluids from getting behind the liner 200, for further resisting relative movement between the two elements 100, 200.

Preferably, the liner is made of a material the can be formed in the required shape and installed into the pump and the process. It can be made as a single unitary piece or made from more than one molded, machined, stamped or extruded pieces that are secured together to make one contiguous liner 200 in the required shape. The liner is preferably made of inexpensive material(s) designed for single or limited use, such as those discussed in AAMI TIR17: 1997.

In order to install the liner 200, preferably the nozzle insert portion 205 is passed through the upper housing nozzle 105. Once passed through, preferably the liner flange 220, can radially extend from the insert portion 205 and be clamped between the nozzle 105 and a connection to the process 5. Thus, the flange 220 acts as an integrally formed gasket to create a seal between the upper housing nozzle 105 and the adjoining process connection 5. Once the flange 220 is secured, it can further help resist relative movement between the liner 200 and the upper housing 100, as the pump 10 cycles between drawing and expelling fluid. Further, this will prevent air or fluids from getting between the liner 200 and the upper housing 100.

Figure 3A:
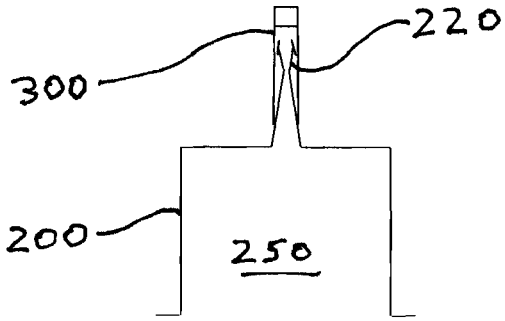
FIGS. 3*a*-3*b* are cross-sectional views of a diaphragm pump liner with an installation member mounted thereon and removed therefrom, respectively, in accordance with an embodiment of the subject invention.
Figure 3B:
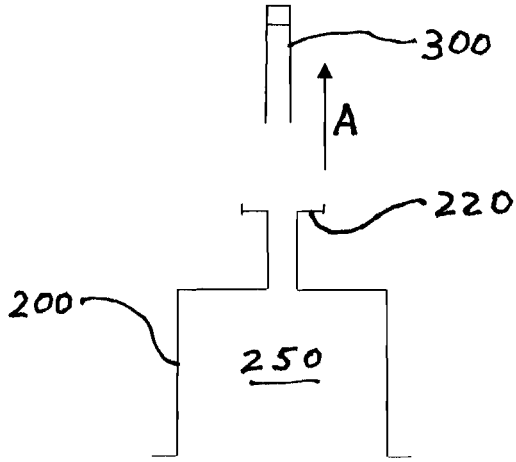

FIG. 3*a* and 3*b* show an alternative installation technique, which uses a constrictor 300 to collapse and/or narrow the upper liner flange 220. FIG. 3*a* shows the constrictor applied to the liner 200. In this embodiment the constrictor 300 is in the form of a removable cap, however tape or other radially constricting methods can be used. Preferably, the constrictor 300, once applied to the flange 220, should be able to easily pass through the inside of nozzle 105. Once the liner 200 is fully seated in the upper housing 100, the constrictor 300 can be pulled away in direction A or otherwise removed, allowing the flange 220 to return to its original shape, as shown in FIG. 3*b*.

Figure 4:
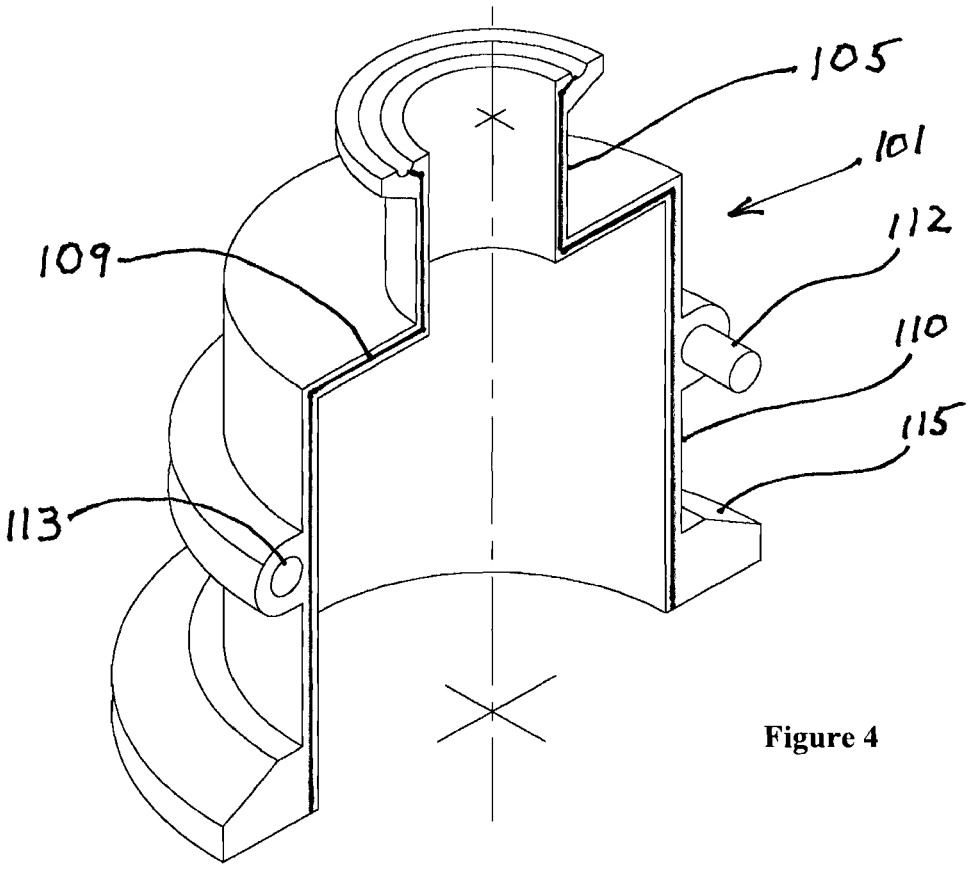
FIG. 4 is a perspective view of a split upper pump housing half, in accordance with an embodiment of the subject invention.

FIG. 4 shows an alternative embodiment for the upper pump housing 101 that is well suited to simplify and expedite installation of the subject liner 200. In particular, an upper housing, similar to upper housing 100 is split vertically (as shown in the orientation of FIG. 4). In this way, the upper pump housing 101 is formed from two or more separable portions or housing segments. A sealing element 109 can be provided along the mating surfaces of the separable housing portions 101, in order to prevent air or fluids from getting inside the housing 101 and behind the liner 200. The embodiment in FIG. 4, shows one of two equal halves of the upper pump housing 101 that when combined form a complete upper housing 101 similar to that discussed above. It should be understood, however, that the two or more housing portions need not be symmetrical to one another or equal in size. The upper flange 220 of the liner can be more easily installed in a split-housing 101, without the need for a constrictor 300. The liner 200 can be inserted into one portion of the split-housing 101 and then the other portion(s) would be mounted thereon to encase the liner 200. Preferably, the split upper pump housing 101 includes a seal between the vertical seams of the separate portions in order to prevent air from getting inside the combined upper housing portions 101. The seal 109 can be in the form of a separate gasket. However, alternatively the liner 200 can be provided with one or more flanges that extend vertically from the outside of liner 200. Thus, the added vertical flanges can serve to seal the seam between the upper housing portions 101. Further, as an alternative, the split-housing 101 can be provided with mating dowels 112 and recesses 113 for aligning the separate portions.

Figure 5:
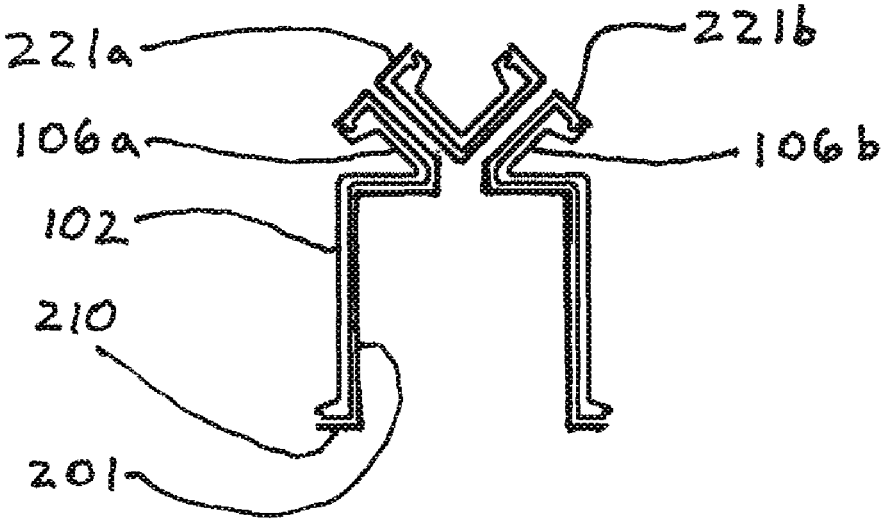
FIG. 5 is a cross-sectional view of an alternative upper pump housing and liner with two fluid ports, in accordance with another embodiment of the subject invention.
Figure 6:
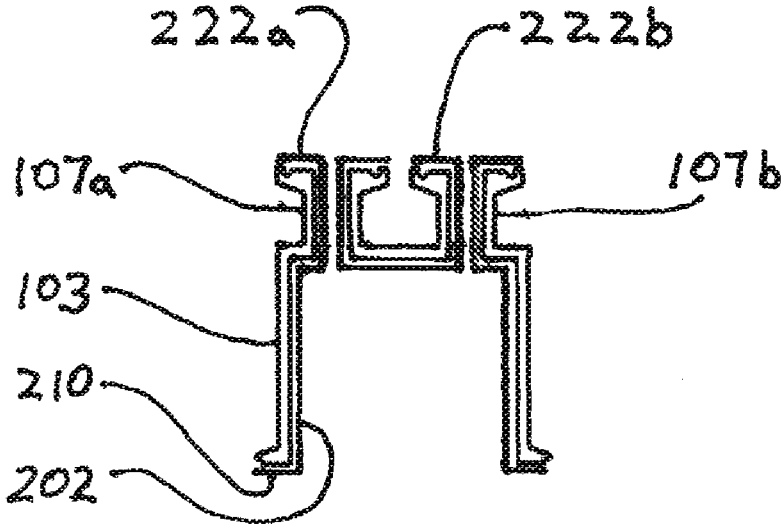
FIG. 6 is a cross-sectional view of another alternative upper pump housing and liner with two fluid ports, in accordance with yet another embodiment of the subject invention.

FIGS. 5 and 6 show further alternative embodiments with the liners 201, 202 matching upper housings 102, 103 which each have more than one fluid port and thereby more than one connection to the process 5. This type of configuration allows for different flow paths, such as fluid flowing in through one port and out through the other. FIG. 5 shows a duel nozzle configuration with the nozzles 106*a*, 106*b* angled away from each other. Accordingly, the liner 201 includes nozzle liners 221*a*, 221*b* in a matching angled configuration. In contrast, FIG. 6, while including two nozzles 107*a*, 107*b* has them extending directly away from the lower portions. However, as with FIG. 5, the liner 202 includes nozzle liners 222*a*, 222*b* that match the configuration of nozzles 107*a*, 107*b*. It should be understood that additional nozzles and nozzle liners can be provided to suit the application. Also, the nozzles can be configured to extend from a more central portion of the upper housings 100, 101, 102, 103.

Figure 7A:
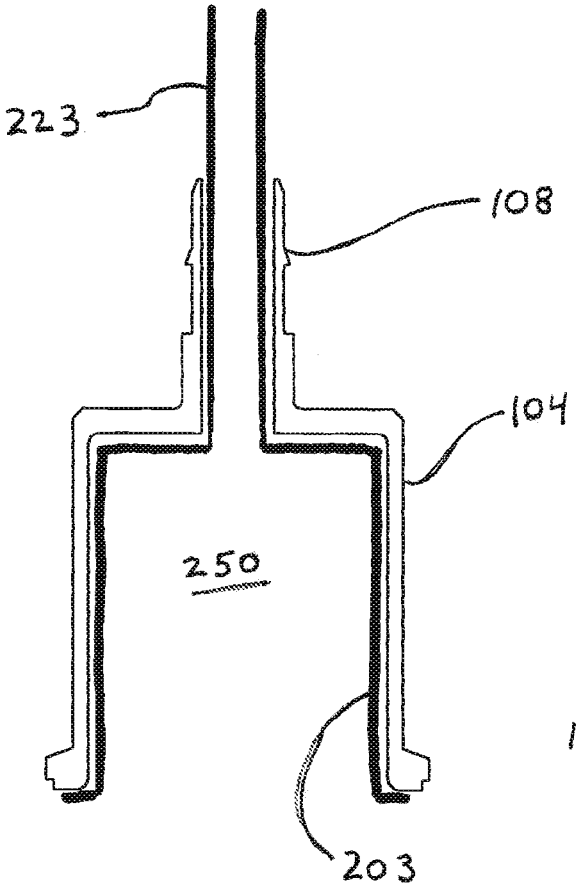
FIGS. 7*a* and 7*b* are cross-sectional views of an alternative upper pump housing and liner, in accordance with yet another embodiment of the subject invention.
Figure 7B:
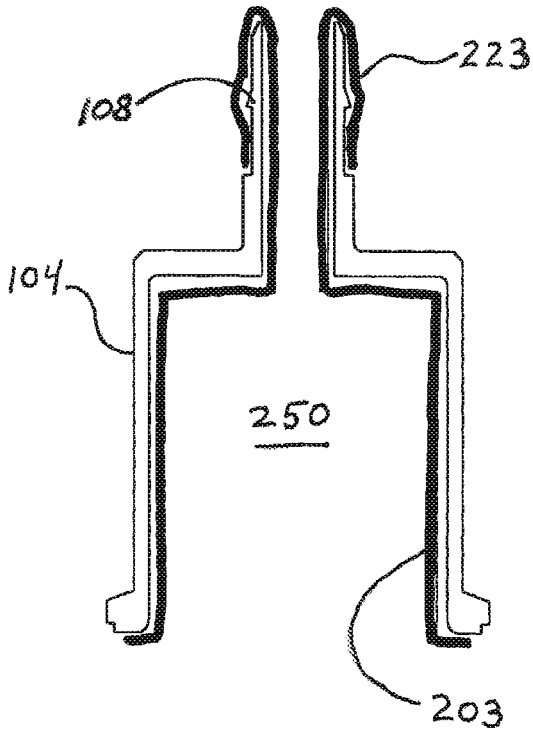

FIGS. 7*a* and 7*b* show a further alternative embodiment of the liner 203 suited for upper housing 104. The upper nozzle 108 of the housing 104 includes a hose barb fitting. Thus, the liner 203 is not provided with a nozzle flange per se, but rather is provided with a nozzle insert portion 223 that extends well beyond the upper portion of the hose barb fitting, as shown in FIG. 7*a*. By using a particularly flexible and/or thin material for the liner 203, the upper extent of the insert portion 223 can be folded back onto the hose barb fitting, as shown in FIG. 7*b*. Thus, allowing the liner 203 and upper housing 104 to be secured together when the hose barb is inserted in the adjoining process (not shown). For example, process tubing can be fitted over the hose barb and thus secured in place. Alternatively, the process could have a male hose barb adapted to be inserted inside the insert portion 223, just inside the nozzle 108.

It should be understood, that while particular examples of process connections have been described and illustrated herein, the subject invention should not be limited to use with those examples. Preferably, the liner and pump assembly as disclosed herein can be attached or coupled to virtually any process application that can use a diaphragm pump.

The diaphragm 150 and liner 200 can be held together by virtue of being sandwiched between the two housing flanges 115, 125 and held by an external clamp. A good seal between these two elements 150, 200 can prevent air from getting behind the liner. Alternatively, these disposable members 150, 200 can be directly bonded or sealed together with a bonding agent or adhesive applied to mating surfaces of one or both members 150, 200. Such bonding agents or adhesive can be applied during installation. Alternatively, the agents or adhesives can be applied before installation, but activated just prior to installation, such as through the application of moisture or by providing a peel-away strip. By bonding or fixedly securing the two members 150, 200, the pump can be more easily disassembled after use without spilling any residual process fluids from inside the liner chamber 250. Ultimately, the permanently secured diaphragm 150 and liner can be removed after use, along with additional upstream secured process elements that are similarly contaminated during use. Such a "closed system" leaves the pump housing 100 and other assembly parts uncontaminated and available for quick reuse. As yet a further alternative, the diaphragm 150 and liner 200 can be formed together as a single continuous unitary member.

In a preferred embodiment, the liner 200, along with the diaphragm 150 are designed as disposable units for single or very limited use. Preferably, only two elements (the liner 200 and the diaphragm 150) ever come in contact with the process fluid. Thus, by providing an easily removable liner 200, together with the diaphragm 150, the contaminated parts can be changed-out and disposed of after a single use. This prevents having to disassemble the entire pump, with the associated potential human or environmental exposure to process constituents, which in some cases may be hazardous. It should be noted that references herein to the term "disposable" are to elements that are designed to be thrown away or discarded after a very limited number of uses and preferably a single use. Even further, before use, the liner 200 along with the diaphragm 150 can be pre-sterilized (by gamma, chemical or moist heat processing) ready for use without the need to clean or sterilize before assembly.

As will be recognized by one of skill in the art, many variations are possible and within the scope of this invention. For example, the pump assembly 10 can be made to any convenient size, from relatively small bench top type systems to large, industrial scale pumping systems. Also, it should be understood that the proportional characteristics of the inner chambers versus the fluid ports can be increased or decreased to suit a desired application.

It should be noted that the fluid can be a homogenous liquid, a composition of disparate fluids or one or more fluids combined with other solid matter. As mentioned above, the fluid is preferably drawn from one or more process lines 5 into the fluid chamber 250 and then expelled through liner port 230.

While various embodiments of the present invention are specifically illustrated and/or described herein, it will be appreciated that modifications and variations of the present invention may be effected by those skilled in the art without departing from the spirit and intended scope of the invention.

What is claimed is:

1. A liner for a first pump housing in a fluid pump assembly, said fluid pump assembly including a first pump housing, a second pump housing and a flexible diaphragm disposed between said first and second pump housings, said first pump housing including a fluid access port for providing fluid communication between an inside housing chamber of said first pump housing and an outside of said first pump housing, said second pump housing securely mated to said first pump housing, said second pump housing including a biasing mechanism for selectively displacing a portion of said diaphragm toward said first pump housing, said liner comprising:

a flexible member removeably secured inside said first pump housing, a first portion of said member shaped to substantially conform to the interior dimensions of said first inner chamber and a second portion of said member shaped to substantially conform to said fluid access port, said member forming an inner liner chamber inside said inside housing chamber, said member including a mating portion for securing said member to said diaphragm to form a seal there between, said inner liner chamber being in fluid communication with said portion of said diaphragm whereby said displacement of said portion of said diaphragm expels fluid from said inner liner chamber through said fluid access port.

2. The liner of claim 1, wherein said member is formed from a single unitary material.

3. The liner of claim 1, wherein said mating portion includes a radially protruding housing flange secured between said first and second pump housings.

4. The liner of claim 1, further comprising:

a nozzle flange radially extending from said second portion.

5. The liner of claim 4, wherein said nozzle flange is collapsible for insertion through said fluid access port.

6. The liner of claim 1, wherein said second portion extends outwardly away from said first pump housing, said second portion being flexible enough to fold over an outer portion of said fluid access port.

7. The liner of claim 1, wherein said member and said flexible diaphragm are permanently secured at said mating portion.

8. The liner of claim 7, wherein said member is secured to said diaphragm by at least one of an adhesive and bonding agent.

9. The liner of claim 1, further comprising said flexible diaphragm integrally formed with said member and extending from said mating portion.

10. The liner of claim 1, further comprising said first pump housing removeably secured to said member, said first pump housing being formed by at least two removeably secured housing segments.

11. The liner of claim 10, further comprising:

a sealing element disposed in a mating region between said housing segments.

12. The liner of claim 11, wherein said sealing element is integrally formed with said member.

13. A fluid pump assembly comprising:

a first pump housing including a first inner chamber, said first pump housing including a fluid access port for providing fluid communication between an outside of said first pump housing and said first inner chamber;

a second pump housing removeably secured to said first pump housing;

a flexible diaphragm disposed between said first and second pump housings, a portion of said diaphragm being selectively displaceable toward said first pump housing; and a flexible liner removeably secured substantially inside said first pump housing, said liner shaped to substantially conform to the interior dimensions of said first inner chamber and said fluid access port, said liner forming an inner liner chamber inside said first inner chamber wherein said liner includes a radially protruding housing flange secured between said first and second pump housings, wherein displacement of said diaphragm toward said first pump housing expels fluid from said inner liner chamber.

14. The fluid pump assembly of claim 13, wherein said liner is formed from a single unitary material.

15. The fluid pump assembly of claim 13, wherein said liner further includes a nozzle flange radially protruding from said liner for engaging an outer portion of said fluid access port.

16. The fluid pump assembly of claim 15, wherein said nozzle flange is collapsible for insertion through said fluid access port.

17. The fluid pump assembly of claim 15, wherein said nozzle flange is flexible enough to fold over an outer portion of said fluid access port.

18. The fluid pump assembly of claim 13, wherein said liner is secured to said diaphragm forming a seal there between.

19. The fluid pump assembly of claim 13, wherein said liner is secured to said diaphragm by at least one of an adhesive and bonding agent.

20. The fluid pump assembly of claim 13, wherein said liner is integrally formed with said diaphragm.

21. The fluid pump assembly of claim 13, wherein said first pump housing is formed by at least two removeably secured housing segments.

22. The fluid pump assembly of claim 21, further comprising:

a sealing element disposed in a mating region between said housing segments.

23. The fluid pump assembly of claim 22, wherein said sealing element is integrally formed with said liner.

* * * * *

UNITED STATES PATENT AND TRADEMARK OFFICE

CERTIFICATE OF CORRECTION

PATENT NO. : 7,726,232 B2
APPLICATION NO. : 12/037805
DATED : June 1, 2010
INVENTOR(S) : Furey et al.

It is certified that error appears in the above-identified patent and that said Letters Patent is hereby corrected as shown below:

Title Page:

Now reads: "(74) Attorney, Agent, or Firm-Hoffman & Baron, LLP"

Should read: -- (74) Attorney, Agent, or Firm-Hoffmann & Baron, LLP --

Signed and Sealed this
Eighteenth Day of January, 2011

David J. Kappos

David J. Kappos
*Director of the United States Patent and Trademark Office*